US007414606B1

(12) United States Patent
Wong et al.

(10) Patent No.: US 7,414,606 B1
(45) Date of Patent: Aug. 19, 2008

(54) METHOD AND APPARATUS FOR DETECTING A FLAT PANEL DISPLAY MONITOR

(75) Inventors: Desmond E. Wong, Scarborough (CA); Gabriel Zoltan Varga, Toronto (CA)

(73) Assignee: ATI International SRL, Christchurch (BB)

( * ) Notice: Subject to any disclaimer, the term of this patent is extended or adjusted under 35 U.S.C. 154(b) by 0 days.

(21) Appl. No.: 09/432,855

(22) Filed: Nov. 2, 1999

(51) Int. Cl.
*G09G 3/36* (2006.01)

(52) U.S. Cl. ..... 345/100; 345/1.1; 345/1.2; 345/104

(58) Field of Classification Search ..... 345/1.1–4, 345/87–101, 104, 204–215, 1; 710/63, 69, 710/70, 3–5, 18, 129, 100–110, 147–150, 710/240; 709/208, 249, 250; 713/300
See application file for complete search history.

(56) References Cited

U.S. PATENT DOCUMENTS 5,159,683 A * 10/1992 Lvovsky et al. ..... 710/9
5,467,470 A * 11/1995 Ninomiya ..... 714/27
5,648,799 A * 7/1997 Kikinis ..... 345/212
5,793,606 A * 8/1998 Cubbage et al. ..... 361/681
5,798,951 A * 8/1998 Cho et al. ..... 710/303
5,850,209 A * 12/1998 Lemke et al. ..... 345/156
5,896,496 A * 4/1999 Suzuki ..... 714/48
5,943,064 A * 8/1999 Hong ..... 345/546
5,969,696 A * 10/1999 Stoye ..... 345/87
6,126,332 A * 10/2000 Cubbage et al. ..... 710/2
6,134,612 A * 10/2000 Bailey et al. ..... 710/62
6,243,780 B1 * 6/2001 Jun ..... 710/316
6,247,084 B1 * 6/2001 Apostol et al. ..... 710/108
6,282,646 B1 * 8/2001 Hendry et al. ..... 713/100
6,329,983 B1 * 12/2001 Wang ..... 345/211
6,493,782 B1 * 12/2002 Verdun et al. ..... 710/300
6,535,944 B1 * 3/2003 Johari et al. ..... 710/302
6,559,859 B1 * 5/2003 Henry et al. ..... 345/690
6,784,855 B2 * 8/2004 Matthews et al. ..... 345/1.1
2001/0047445 A1 * 11/2001 Lum ..... 710/129

* cited by examiner

*Primary Examiner*—Vijah Shankar
(74) *Attorney, Agent, or Firm*—Vedder Price P.C.

(57) ABSTRACT

In a specific embodiment of the present invention, a monitor detect pin associated with a connector for a flat panel display (FPD) is monitored by a detect module. When an external flat panel device is connected, the monitor detect pin is activated. In response to the monitor detect pin being activated, a system interrupt is generated. System software can determine whether to drive FPD. When an external FPD is disconnected, the transmission minimized differential signaling drivers are disabled.

15 Claims, 5 Drawing Sheets

METHOD AND APPARATUS FOR DETECTING A FLAT PANEL DISPLAY MONITOR

FIELD OF THE INVENTION

The present invention relates generally to a method and apparatus for detecting a flat panel display, and more specifically to a method of detecting a flat panel display and subsequently enabling or disabling drivers associated with the monitor.

BACKGROUND OF THE INVENTION

The ability to drive display devices is integral to the operation of computers. The use of Flat Panel Displays (FPDs) as an external display device is becoming more prevalent. Prior art methods of driving external Flat Panel Display (FPD) monitors require the host computer, whether a desktop or a laptop, be powered down prior to the monitor being connected. By doing so, the monitor is detected during the start-up routine of the computer.

Recent FPD advancements, which include Liquid Crystal Display (LCD) monitors, have defined the state of a signal associated with the flat panel monitor to indicate when the flat panel monitor is connected and powered-up. A method and apparatus capable of allowing the hot-plugging of such a flat panel display would be advantageous.

DETAILED DESCRIPTION OF THE DRAWINGS

In a specific embodiment of the present invention, a monitor detect pin is monitored by a detect circuit. When the monitor detect pin is activated, it can be determined that an external LCD or FPD has been connected. In response, an interrupt is generated and provided to the display engine. In addition, it is determined whether or not an enable signal in a corresponding register is activated. If the enable signal is activated, a system interrupt is generated, which can notify software to enable an FPD engine to drive an external flat panel display. When the enable register is not activated no system interrupt is generated. The system interrupt allows software associated with the display to perform tasks such as initialization of the display drivers.

Figure 1:
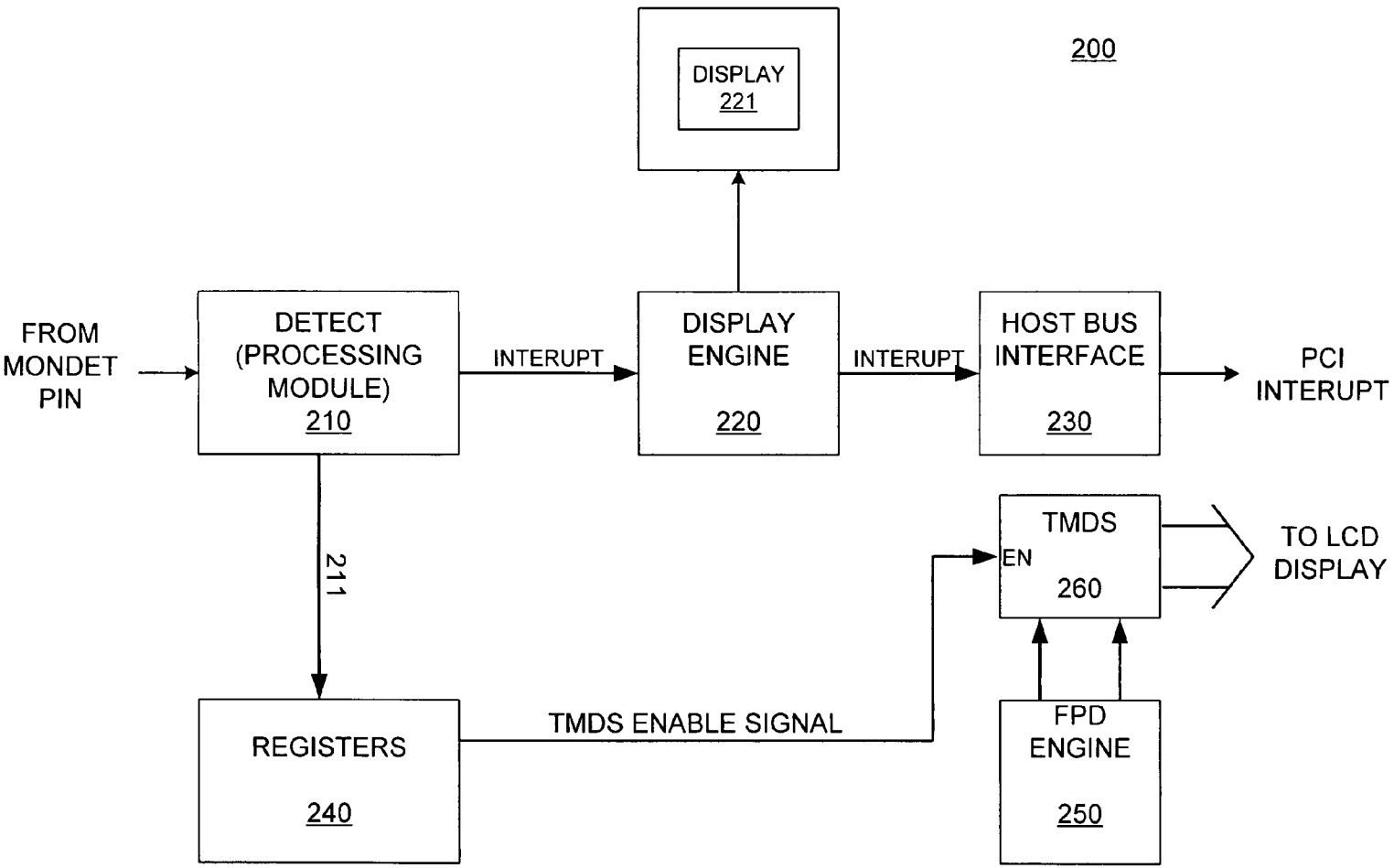
FIG. 1 illustrates, in block diagram form, a detection system in accordance with the present invention.

The present invention is best understood with reference to the FIGS. 1-5. FIG. 1 illustrates a block diagram of a system capable of implementing the present invention. The system of FIG. 1 includes a detect module 210, display engine 220, display 221, host bus interface 230, registers 240, FPD engine 250, and a TMDS (Transmission Minimized Differential Signaling) transmitter 260.

In operation, the detect module 210 receives an input signal from the monitor detect pin labeled MONDET. In response, the detect module 210 provides an interrupt signal to the display engine 220 that is qualified by an enable field of the register set 240. The display engine 220, which in one mode of operation provides a display signal to system display 221, provides an interrupt to the host bus interface 230. Ultimately, in response to the interrupt from the detect module 210, the host bus interface 230 provides the interrupt to the system. The detect circuit 210 accesses registers 240 to control its own operation, and operation of TMDS transmitter 260. Specifically, TMDS transmitter 260 is enabled by the signal labeled TMDS ENABLE SIGNAL which is either generated from the fields of register set 240, or is actually stored in a field of the register set 240.

In one mode of operation, the display engine 220 will be providing display information to the display 221. The images being processed and displayed by the display engine 220 are received either from the system bus, or from a video memory, neither of which are illustrated in FIG. 1. In one mode of operation, only the display 221 is being driven. When no FPD is available, the monitor detect pin is monitored by detect module 220 to determine when an external FPD becomes available. This is better illustrated with reference to FIG. 2.

Figure 2:
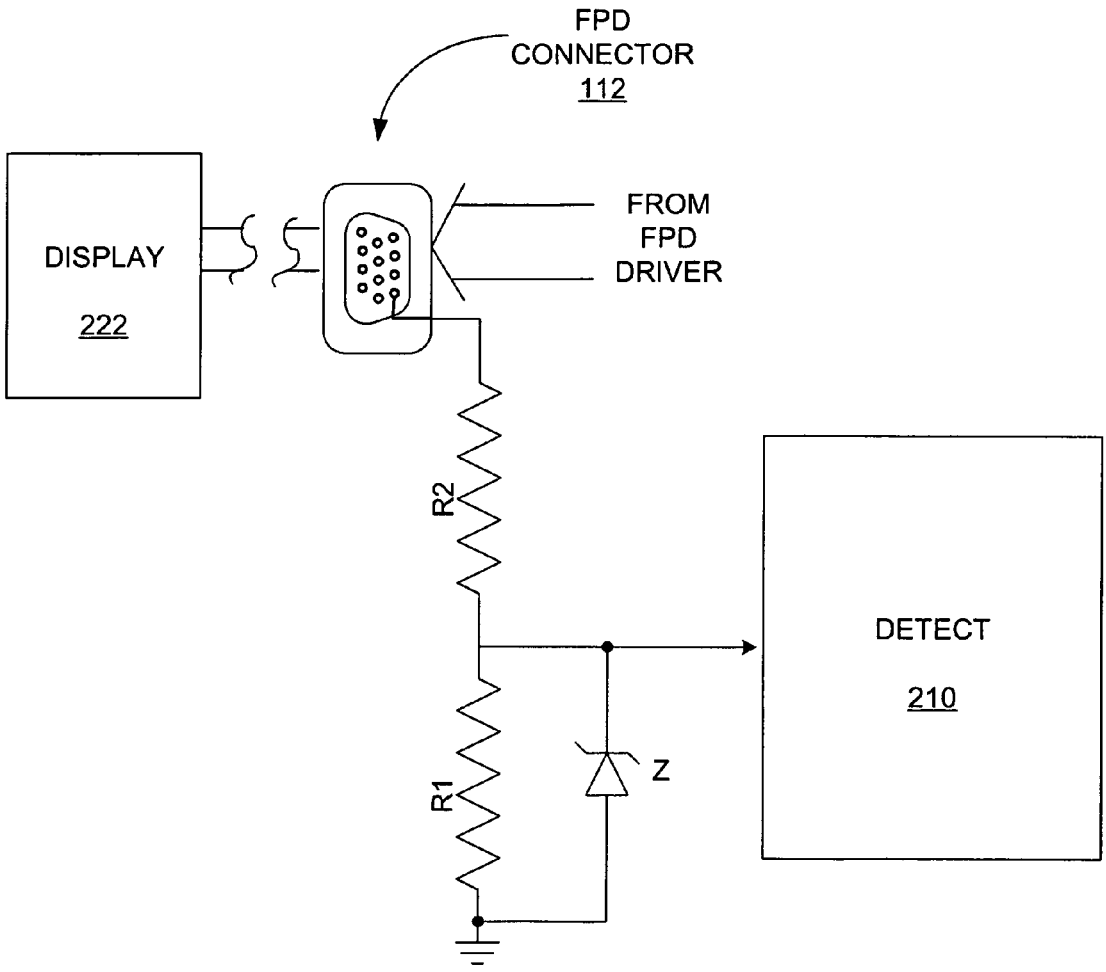
FIG. 2 illustrates, in block and schematic form, a portion of the detection system of FIG. 1.

FIG. 2 illustrates a simple voltage divider circuit comprising resistive elements R1 and R2 and zener diode Z. One end of the divider circuit is connected to the monitor detect pin while the other end is connected to a voltage reference point. A zener diode, or other voltage reference device, is connected between the divider point and ground to clamp the voltage seen by the detect module 210. In the specific embodiment illustrated in FIG. 2, when no monitor is connected to the FPD connector 112, the voltage at the divider point of the network R1-R2 is at the voltage reference point. In the example illustrated, the voltage reference point is ground, thereby providing a logic level 0 at the divider point. The logic level zero state is received and detected by the detect module 210 of FIG. 1.

When a flat panel display is connected to the FPD connector 112, the monitor detect pin will be driven to a voltage level supplied by the flat panel and regulated by the zener diode. Generally, this supplied voltage will be such that the zener diode connected at the division point of the resistive elements will be clamped at a level providing a logic level 1 to the display detect module 210. One of ordinary skill in the art will recognize that other detection circuits and/or methods can be implemented, such as detection of pulsed signals, and current sourced signals.

Referring once again to FIG. 1, when a valid detect signal is received from the monitor detect pin, the detect module 210 provides an interrupt signal to the display engine 220. In the specific embodiment illustrated, the display engine 220 is responsible for providing display information to the display 221. Based upon the interrupt, the display engine 220 provides an interrupt to the host bus interface, which interfaces to the system. By providing a system (PCI) interrupt, the operating system is notified that an additional monitor has been connected. The software may optionally choose to drive the monitor. This is advantageous in that the display engine is connected to host bus interface 230.

In addition to initiating the generation of the system interrupt, the detect module 210 also accesses the registers 240. Access of the registers 240 is generally done in order to update values of various registers and to determine operation of the detect module 210. Specifically, a register labeled MONDET_SENSE is updated by the detect module 210 to indicate the value sensed on the MONDET pin.

When initialized, the FPD engine 250 will retrieve display information over either a system bus, or a bus (not illustrated) that interfaces to video/graphics memory. The FPD engine 350 processes the data as appropriate for the connected FPD, and provides data to the TMDS transmitter 260 for display. The TMDS transmitter 260 is connected to the external FPD monitor through the connector 112 of FIG. 2, which also houses the monitor detect pin. The TMDS transmitter 260 is enabled by a signal labeled TMDS ENABLE, which is discussed in greater detail herein.

Figure 3:
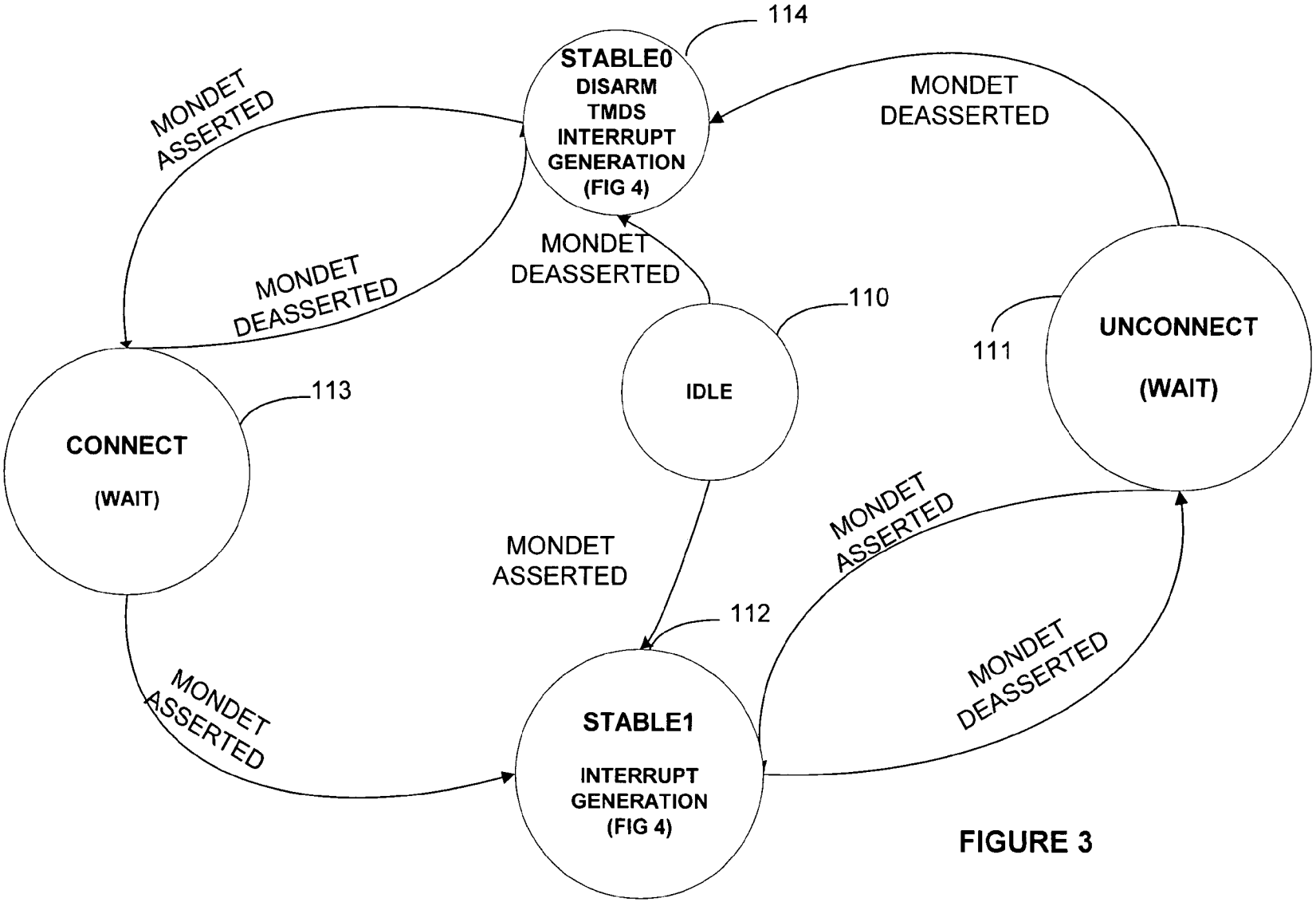
FIG. 3 illustrates a state diagram in accordance with the present invention.

FIG. 3 illustrates a state diagram representing the operation of the detect circuit 210. On reset, or power-up, the detect circuit 210 enters an idle state labeled IDLE 110 as illustrated in FIG. 3. Based on the value of the MONDET pin, detect module 210 will transition to the state labeled STABLE0 114 or STABLE1 112. For purposes of example, it will be assumed that the system is powered up and operating in a normal mode with no external display connected and detect module 210 has transitioned to state STABLE0 114.

The detect module 210 transitions from state STABLE0 114 to the CONNECTED (wait) state 113 when an asserted signal is detected on the monitor detect pin. The monitor detect pin is considered asserted when a transition from a negated state to an asserted state is detected. For example, in one embodiment, when the monitor detect pin goes from a logic level 0 to a logic level 1, the monitor detect pin is considered asserted. State 113 operates as an intermediate state used to verify a FPD monitor has actually been connected and/or powered up. Therefore, if the monitor detect pin remains asserted for a specific amount of time the detect module 210 will transition from state 113 to the STABLE1 state 112, otherwise the detect module will transition from state 113 back to the STABLE0 state 114.

When in state STABLE1 it has been determined that an external FPD monitor is connected. Upon entering state STABLE1 112, interrupt generation is processed based on the flow of FIG. 4. At step 203 of FIG. 4, a determination is made whether the generation of an interrupt is enabled. In the specific example, the interrupt is enabled based upon a register field labeled MONDET_INT_EN. If not enabled, no system interrupt is generated. If enabled, an interrupt labeled oMONDET_INT is set equal to one to indicate generation of the interrupt. In response to the interrupt, system software may initialize the FPD engine 250 in a manner dependent upon the FPD monitor. Subsequently, video/graphics data may be provided to the FPD engine for display on the FPD using TMDS transmitter 260.

A transition from state 112 to the UNCONNECTED (wait) state 111 occurs when the monitor detect pin has been negated. The UNCONNECTED state 111 serves to determine whether or not a valid monitor detect signal has been lost. This is accomplished by determining if the monitor detect signal remains negated. The detect module 210 transitions from the UNCONNECTED state 111 to STABLE0 state 114 when the monitor detect signal remains negated, otherwise, the module 210 will transition back to the STABLE1 state 112.

When in state STABLE0 114 it has been determined that an external FPD monitor is disconnected. Upon entering state STABLE0 114, the detect module disarms the TMDS drivers, and performs interrupt generation based on the flow of FIG. 4. At step 201 of FIG. 4, a determination is made whether the generation of an interrupt is enabled. In the specific example, the interrupt is enabled based upon a register field labeled MONDET_INT_EN. If not enabled, no system interrupt is generated. If enabled, an interrupt labeled oMONDET_INT is set equal to one to indicate generation of the interrupt. Based upon the interrupt, system software may initialize the FPD engine 250 in a conventional manner to an idle mode.

One skilled in the art will recognize that other implementations of the detect module 210 can be implemented. For example, additional states can be added to assist in the start-up operation.

The table below represents a specific implementation of the registers 240 of FIG. 1.

| BIT NAME | R/W | DESCRIPTION |
|---|---|---|
| MONDET_SENSE | R | Direct input from MONDET pin<br>0 = No Panel Connected<br>1 = Panel Connected |
| MONDET_INT_POL | R/W | 0 = Interrupt on falling edge of MONDET<br>1 = Interrupt on rising edge of MONDET |
| MONDET_INT_EN | R/W | 0 = No Interrupts based upon MONDET_SENSE<br>1 = Interrupt when specified edge occurs per MONDET_INT_POL field |
| MONDET_INT_ACK | R/W | Read:<br>1 = Edge has occurred on MONDET<br>0 = Specified Edge has not occurred on MONDET pin<br>Write:<br>1 = Clear bit to 0 |
| TMDS_MONDET_EN | R/W | 0 = Disable TMDS Transmitter when MONDET low<br>1 = TMDS transmitter ignores state of MONDET pin |
| TMDS_STATUS | R | 0 = TMDS transmitter disabled by MONDET low<br>1 = TMDS transmitter armed |
| EN_TMDS | R/W | 0 = Disable use of TMDS transmitter<br>1 = Enable use of TMDS transmitter |

The field MONDET_SENSE register is a read only register, relative to the system, that contains the present value of the MONDET pin. This register is updated by the detect module 210. By reading this register value, the value of the MONDET pin is obtained. In other implementations, the MONDET pin value could be monitored or read directly.

The field labeled MONDET_INT_POL indicates whether a rising or falling edge is to be detected on the MONDET pin. When MONDET_INT_POL is set to a logic level 0 an interrupt will be generated on a falling edge, when set to a logic level 1 an interrupt will be generated on the rising edge of monitor detect. This field can be read or written to by the system to implement the state and flow diagrams herein.

The field labeled MONDET_INT_EN qualifies the generation of an interrupt based upon the MONDET pin value. Specifically, no interrupt will be generated based upon the MONDET pin when set to 0. When set to 1, an interrupt, such as a PCI interrupt will be generated for the edge indicated in field MONDET_INT_POL. This field can be read or written to by the system.

The field labeled MONDET_INT_ACK, is asserted to a logic level 1 when the edge specified in the MONDET_INT_POL field has occurred, and remains negated, logic level 0, when the specified edge has not occurred. In a specific implementation, this register is a pulsed register in that the value 1 is provided to the field for only a predetermined amount of time. By writing a 1 to this register, the field is actually cleared to 0.

An enable field, labeled TMDS_MONDET_EN when asserted allows the disabling of the TMDS transmitter based upon the MONDET pin. In one embodiment, when asserted, the TMDS transmitter 260 is disabled when the field MON- DET pin is low. When negated, the MONDET pin has no affect on TMDS transmitter 260.

A field labeled TMDS_STATUS is a read only register indicating the status of the FIG. 1 signal labeled TMDS ENABLE SIGNAL. When deasserted, the TMDS transmitter 260 is disabled by a monitor detect low signal. When asserted, the TMDS transmitter 260 is armed, and therefore capable of driving an external FPD.

The EN_TMDS field is set to a logic level 0 in order to disable the TMDS transmitter 260. The EN_TMDS field is set to a logic level 1 in order to enable the TMDS transmitter 260. This field can be read or written to by the system.

Figure 4:
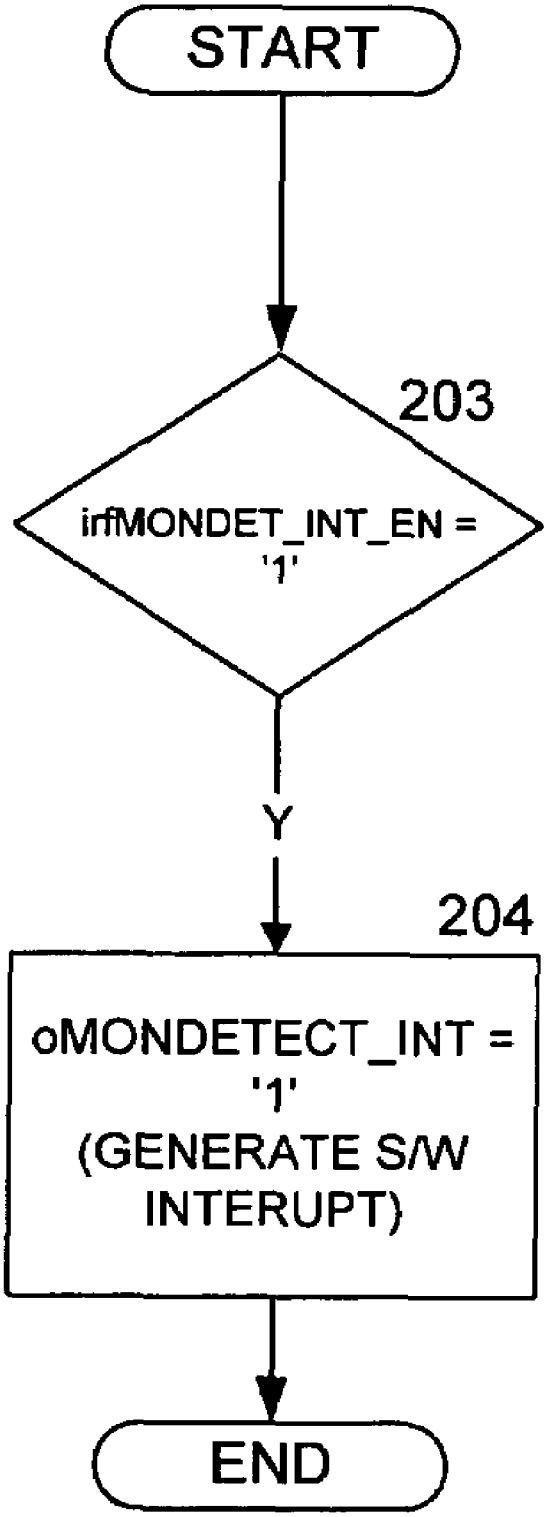
FIG. 4 illustrates a flow diagram in accordance with the present invention.

One skilled in the art will recognize that the registers specified in the previous table can be utilized to implement the state machine of FIG. 2, as well as the flow diagram of FIG. 4.

It should be understood that the specific steps indicated in the methods herein, and/or the functions of specific modules herein, may be implemented in hardware and/or software. For example, a specific step or function may be performed using software and/or firmware executed on one or more a processing modules.

In general, a system for providing display information may include a more generic processing module and memory. The processing module can be a single processing device or a plurality of processing devices. Such a processing device may be a microprocessor, microcontroller, digital processor, microcomputer, a portion of a central processing unit, a state machine, logic circuitry, and/or any device that manipulates the signal. The detect module 210 may include a processing module of this type.

The manipulation of the signals described herein can be based upon operational instructions represented in a memory. The memory may be a single memory device or a plurality of memory devices. Such a memory device may be a read only memory, a random access memory, a floppy disk memory, magnetic tape memory, erasable memory, a portion of a system memory, and/or any device that stores operational instructions in a digital format. Note that when the processing module implements one or more of its functions, it may do so where the memory storing the corresponding operational instructions is embedded within the circuitry comprising a state machine and/or other logic circuitry.

Figure 5:
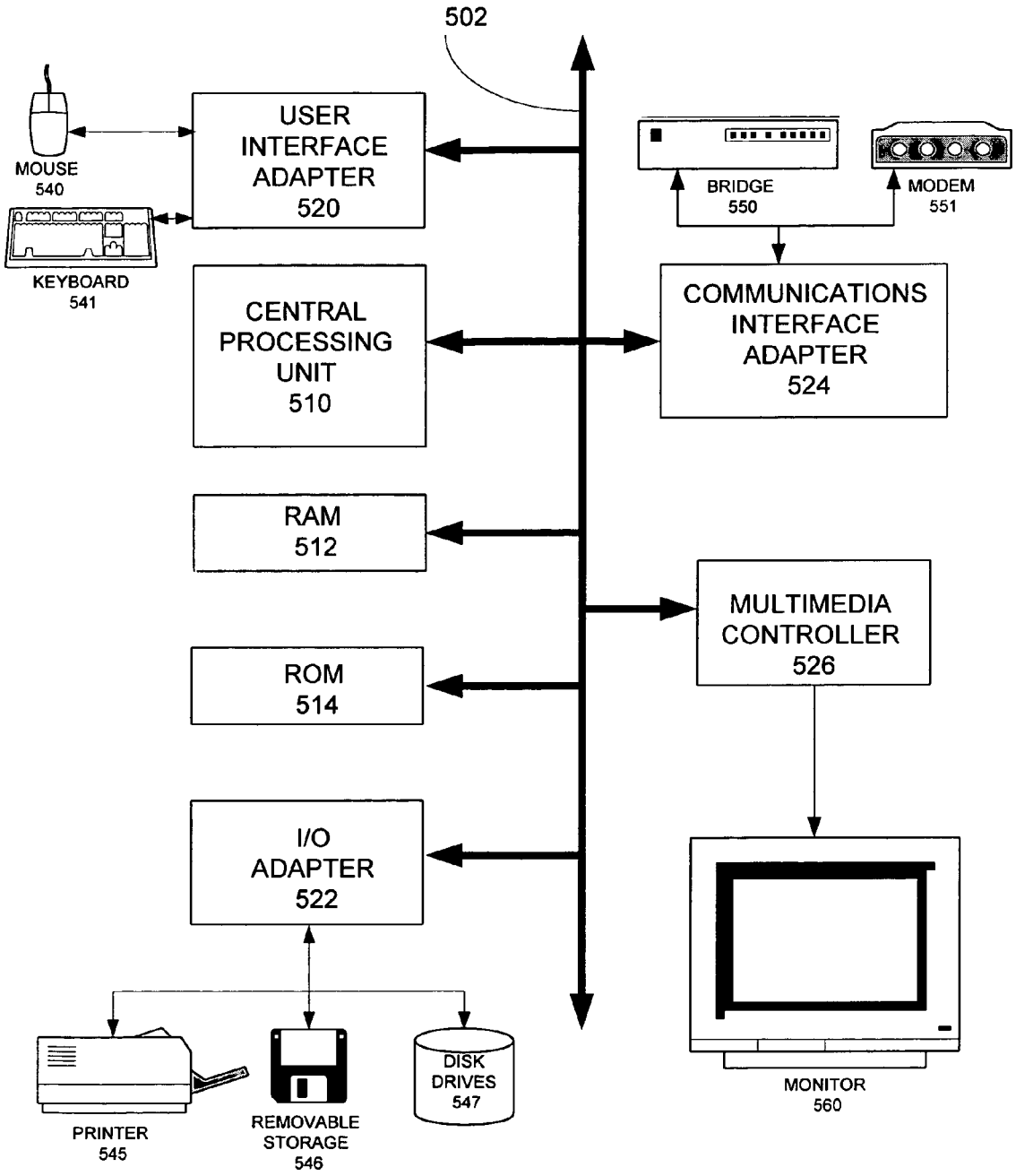
FIG. 5 illustrates, in block form, a computer system capable of supporting the present invention.

FIG. 5 illustrates, in block diagram form, a processing device in the form of a general purpose or personal computer system 500. The computer system 500 is illustrated to include a central processing unit 510, which may be a conventional proprietary data processor, memory including random access memory 512, read only memory 514, and input output adapter 522, a user interface adapter 520, a communications interface adapter 524, and a multimedia controller 526.

The input output (I/O) adapter 522 is further connected to, and controls, disk drives 547, printer 545, removable storage devices 546, as well as other standard and proprietary I/O devices.

The user interface adapter 520 can be considered to be a specialized I/O adapter. The adapter 520 is illustrated to be connected to a mouse 540, and a keyboard 541. In addition, the user interface adapter 520 may be connected to other devices capable of providing various types of user control, such as touch screen devices.

The communications interface adapter 524 is connected to a bridge 550 such as is associated with a local or a wide area network, and a modem 551. By connecting the system bus 502 to various communication devices, external access to information can be obtained.

The multimedia controller 526 will generally include a video graphics controller capable of displaying images upon the monitor 560, as well as providing audio to external components (not illustrated).

Generally, the system 500 will be capable of implementing the system and methods described herein. Specifically, the multimedia controller 526 can include the detect circuit of FIG. 2, as well as the display engine 220, the FPD engine 250, TMDS transmitter 260, and host bus interface 230. The monitor 560 can be analogous to a flat panel monitor being detected.

One skilled in the art will recognized that many variations to the present invention would be anticipated. For example, the term FPD as used herein would further apply to liquid crystal displays. In addition, the register set disclosed herein could be implemented using other storage elements besides register sets.

It should now be apparent that the present invention provides specific advantages over the prior art. Specifically, the present invention allows for the recognition of a hot plugged external flat panel display. The specific embodiment described herein, provides for the system to be notified through an interrupt mechanism, and the FPD engine 250 to provide appropriate signals to the TMDS transmitter 260. As a result, greater flexibility is achieved with the present system as opposed to those of the prior art.

We claim:

1. A method for detecting a monitor, the method comprising:

providing display information to a first display;

determining when an external flat panel display becomes available, by monitoring at least one pin of a connector coupled to a flat panel display;

asserting an output signal to indicate the pin is in a first state;

providing an interrupt signal in response to the asserted output signal; and providing display information to the external flat panel display in response to the interrupt signal.

2. The method of claim 1 further including determining if an interrupt enable signal is activated and if so providing the interrupt signal.

3. The method of claim 1 including determining if a voltage level of the first pin of the connector coupled to flat panel display is in a stable state before asserting the output signal.

4. A system for providing a display image to a flat panel monitor, the system comprising:

a processing module; and memory operably coupled to the processing module, wherein in the memory stores operational instructions that cause the processing module to:

monitor one pin of a connector coupled to a flat panel display;

assert a output signal to indicate the one pin is in a first state; and receive the output signal at a display engine.

5. The system of claim 4 wherein the output signal is a system interrupt signal for a general purpose computer.

6. A method for detecting a monitor, the method comprising:

monitoring one pin of a connector coupled to a flat panel display;

asserting an output signal to indicate the one pin is in a first state; and receiving the output signal at a display engine.

7. The method of claim 6, wherein the output signal is an interrupt signal.

8. The method of claim 7, wherein the interrupt signal is a system interrupt for a general purpose computer.

9. The method of claim 6, further comprising determining if a voltage level of the one pin is in a stable state before asserting the output signal.

10. The method of claim 9, wherein determining includes the voltage level of the one pin being stable when the input is stable for a predetermined amount of time.

11. The method of claim 10, wherein the output signal is stored in a register.

12. The method of claim 6 further comprising:

operating in a normal mode of operation prior to monitoring, wherein the one pin is in a second state.

13. The method of claim 6, wherein the first state is indicative of a flat panel display being coupled to the connector.

14. The method of claim 6, wherein the first state is indicative of a flat panel display being decoupled from the connector.

15. The method of claim 6 further comprising:

driving the flat panel display from a flat panel display engine in response to asserting the first output signal.

* * * * *